US006376034B1

(12) United States Patent
Brander

(10) Patent No.: US 6,376,034 B1
(45) **Date of Patent: *Apr. 23, 2002**

(54) ABSORBENT MATERIAL FOR USE IN DISPOSABLE ARTICLES AND ARTICLES PREPARED THEREFROM

(76) Inventor: William M. Brander, 280 Hallah Cir., Atlanta, GA (US) 30328

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/096,788

(22) Filed: Jun. 12, 1998

Related U.S. Application Data

(63) Continuation-in-part of application No. 08/787,839, filed on Jan. 23, 1997, now Pat. No. 5,820,955.

(60) Provisional application No. 60/010,454, filed on Jan. 23, 1996.

(51) Int. Cl.[7] ..... C09K 3/00; C08L 1/00; C08L 1/08

(52) U.S. Cl. ..... 428/35.2; 428/35.7; 428/532; 426/124; 252/194; 524/35; 524/47; 524/48

(58) Field of Search ..... 426/124; 524/35, 524/47, 48; 252/194; 428/35.2, 35.3, 35.7, 36.92, 326, 327, 532

(56) References Cited

U.S. PATENT DOCUMENTS

| | | | | |
|---|---|---|---|---|
| 3,066,847 | A | 12/1962 | Fortune | 229/68 |
| 3,156,402 | A | 11/1964 | Dupuis et al. | 229/30 |
| 3,559,416 | A | 2/1971 | Cornwall | 62/4 |
| 3,670,731 | A | 6/1972 | Harmon | 128/284 |
| 3,834,606 | A | 9/1974 | Andersson | 229/2.5 |
| 3,881,489 | A | 5/1975 | Hartwell | 128/287 |
| 3,935,363 | A | 1/1976 | Burkholder et al. | 428/281 |
| 3,965,906 | A | 6/1976 | Karami | 128/287 |
| 3,981,100 | A | 9/1976 | Weaver et al. | 47/58 |
| 3,981,110 | A | 9/1976 | Weaver et al. | 47/58 |
| 3,989,867 | A | 11/1976 | Sisson | 428/132 |
| 3,990,872 | A | 11/1976 | Cullen | 55/274 |
| 3,993,553 | A | 11/1976 | Assarsson et al. | 204/159 |
| 3,999,653 | A | 12/1976 | Haigh et al. | 206/584 |
| 4,055,180 | A | 10/1977 | Karami | 128/287 |
| 4,181,285 | A | 1/1980 | Vangedal-Nielsen | 249/61 |
| 4,252,269 | A | 2/1981 | Peppiatt | 229/54 R |
| 4,275,811 | A | 6/1981 | Miller | 206/204 |
| 4,321,997 | A | 3/1982 | Miller | 206/204 |
| 4,382,507 | A | 5/1983 | Miller | 206/204 |
| 4,404,820 | A | 9/1983 | Romaine | 62/530 |
| 4,410,578 | A | 10/1983 | Miller | 428/117 |
| 4,442,969 | A | 4/1984 | Holden | 229/2.5 R |
| 4,454,055 | A | 6/1984 | Richman et al. | 252/194 |
| 4,487,791 | A | 12/1984 | Komatsu et al. | 428/35 |
| 4,550,439 | A | 10/1985 | Peppiatt et al. | 383/8 |
| 4,552,600 | A | 11/1985 | Laiewski et al. | 156/73.1 |
| 4,573,203 | A | 2/1986 | Peppiatt | 383/8 |
| 4,573,578 | A | 3/1986 | Greminger, Jr. et al. | 206/524.4 |
| 4,576,278 | A | 3/1986 | Laiewski et al. | 206/204 |
| 4,596,250 | A | 6/1986 | Beisang, III et al. | 128/402 |
| 4,615,923 | A | 10/1986 | Marx | 428/35 |
| 4,619,361 | A | 10/1986 | Thomas, Jr. | 206/204 |
| 4,702,377 | A | 10/1987 | Grone | 206/557 |

(List continued on next page.)

*Primary Examiner*—Rena L. Dye
(74) *Attorney, Agent, or Firm*—Thomas, Kayden, Horstemeyer & Risley

(57) ABSTRACT

An absorbent composition of matter includes a non-crosslinked gel forming polymer and at least one clay and preferably including a trivalent cation. The absorbency of the composition exceeds the sum of absorbencies of the components of the blend. The gel formed as a result of absorbency of fluid is non-slimy and has a high gel strength. The composition can be used with food products when made with all food safe ingredients. An absorbent article incorporating the absorbent material can be used for storage of food products.

14 Claims, 2 Drawing Sheets

U.S. PATENT DOCUMENTS 4,713,839 A 12/1987 Peppiatt ..... 383/29
4,742,908 A 5/1988 Thomas, Jr. et al. ..... 206/554
4,780,117 A 10/1988 Lahey et al. ..... 62/4
4,815,590 A 3/1989 Peppiatt et al. ..... 206/204
B14,573,203 A 4/1989 Peppiatt ..... 383/29
4,856,651 A 8/1989 Francis, Jr. ..... 206/219
4,861,632 A 8/1989 Caggiano ..... 428/35.2
4,877,336 A 10/1989 Peppiatt ..... 383/8
4,898,273 A 2/1990 Kristiansen ..... 206/204
4,914,066 A 4/1990 Woodrum ..... 502/62
4,927,010 A 5/1990 Kannankeril ..... 206/204
4,929,480 A 5/1990 Midkiff et al. ..... 428/35.6
4,940,621 A 7/1990 Rhodes et al. ..... 428/137
4,949,897 A 8/1990 Pawiak et al. ..... 229/2.5 R
4,984,907 A 1/1991 Power ..... 383/109
4,984,908 A 1/1991 Kronenberger et al. ..... 384/478
4,995,217 A 2/1991 Francis, Jr. ..... 53/410
4,998,671 A 3/1991 Leifheit ..... 239/44
5,022,945 A 6/1991 Rhodes et al. ..... 156/253
5,031,418 A 7/1991 Hirayama et al. ..... 62/530
5,033,867 A 7/1991 Peppiatt ..... 383/29
5,033,868 A 7/1991 Peppiatt ..... 383/29
5,035,241 A 7/1991 Walasek et al. ..... 128/403
5,054,290 A 10/1991 Hogan ..... 62/45.1
5,055,332 A 10/1991 Rhodes et al. ..... 428/74
5,080,497 A 1/1992 Peppiatt ..... 383/21
5,112,138 A 5/1992 Peppiatt ..... 383/29
5,135,787 A 8/1992 Bair ..... 428/36.1
5,150,707 A 9/1992 Anderson ..... 128/402
5,160,308 A 11/1992 Peppiatt ..... 493/235
5,174,657 A 12/1992 Peppiatt ..... 383/8
5,176,930 A 1/1993 Kannankeril et al. ..... 426/124
5,221,143 A 6/1993 Peppiatt ..... 383/29
5,263,479 A 11/1993 Tesch ..... 607/114
5,265,401 A 11/1993 Gujer et al. ..... 53/546
5,271,244 A 12/1993 Staggs ..... 62/457.3
5,346,312 A 9/1994 Mabry et al. ..... 383/113
5,356,678 A 10/1994 Heitzhaus et al. ..... 428/35.6
5,361,465 A 11/1994 O'Donnell ..... 27/29
5,366,791 A 11/1994 Carr et al. ..... 428/195
5,372,429 A 12/1994 Beaver, Jr. et al. ..... 383/109
5,386,803 A 2/1995 Hughes ..... 119/173
5,393,462 A 2/1995 Avery ..... 252/315.5
5,417,276 A 5/1995 Dobry ..... 165/10
5,447,532 A 9/1995 Furuya ..... 607/114
5,552,169 A 9/1996 Kannankeril et al. ..... 426/107
5,660,868 A 8/1997 Yeager ..... 426/124
5,709,089 A 1/1998 Dawson et al. ..... 62/4
5,709,897 A 1/1998 Pearlstein ..... 426/106
5,720,999 A 2/1998 Lanzani et al. ..... 426/129
5,839,572 A 11/1998 Yeager ..... 206/204
5,845,769 A 12/1998 Yeager ..... 206/204

ABSORBENT MATERIAL FOR USE IN DISPOSABLE ARTICLES AND ARTICLES PREPARED THEREFROM

RELATED APPLICATIONS

This application is a continuation-in-part application claiming priority from U.S. patent application Ser. No. 08/787,839, filed Jan. 23, 1997, now U.S. Pat. No. 5,820,955, which claims priority from U.S. Provisional Patent Application Ser. No. 60/010,454, filed Jan. 23, 1996.

FIELD OF THE INVENTION

The invention relates generally to moisture absorbent articles such as diapers, incontinence articles, feminine hygiene products such as tampons and pads, absorbent dressings, pads for food packaging, and the like. More particularly, the invention relates to compositions of matter for use in disposable articles for the absorption of water, urine, blood, and other fluids and to an absorbent pouch for storing food products.

BACKGROUND OF THE INVENTION

There has been abundant activity in recent years in the area of absorbent compositions and articles incorporating the same, such as diapers, incontinence articles, feminine hygiene products, absorbent dressings, and food packaging. The prior art teaches the use of water insoluble crosslinked polymeric substances which possess the ability to absorb large quantities of fluids relative to their own weight and volume. Such polymeric materials include starch graft copolymers, crosslinked salts of acrylic acid, in particular sodium polyacrylate, and crosslinked cellulose derivatives, including crosslinked sodium carboxymethylcellulose (CMC). Many of the listed polymers are not approved as safe for incorporation into or contact with food products. Some types of non-crosslinked CMC, however, have been approved for use in food applications.

It is well known that non-crosslinked cellulose derivatives, such as from CMC, hydroxyethylcellulose, methylcellulose, and hydroxypropylmethylcellulose, produce a soft gel when hydrated, having low gel strength, and an unpleasant slippery (slime like) feel. This mitigates against their use, particularly in food packaging applications. Further, the gel formed from such materials can produce a gel block effect when used in absorbent articles. Gel block effect refers to the tendency of a gel to form around the masses of CMC particles, thus slowing or preventing fluid from being taken up by the internally- situated particles. This minimizes the usable absorbent capacity of the material.

The gel block effect can be minimized by using crosslinked CMC. This also has the effect of strengthening the gel. However, the cost of chemically crosslinked CMC in granular form has prevented its commercial development. Its use in food packaging would also require formal FDA approval, because of the chemical processes involved in preparing the crosslinked material.

Clays, and other mineral compositions such as diatomaceous earth, are known for their aqueous liquid absorbing properties. However, the use of clay, alone, may be problematic for some applications, due to its colloidal, dispersive properties in water. To this effect, the prior art teaches the use of clays in combination with other ingredients such as polymers. For example, U.S. Pat. No. 3,935,363 to Burkholder et al. teaches that clay minerals have enhanced water absorbing properties when flocculated into granular aggregates using small amounts of an inorganic salt solution and/or a water soluble polymeric flocculating agent such as polyacrylic acid and then dried. U.S. Pat. No. 4,914,066 to Woodrum teaches a blend of bentonite clay (>85%) and a water swellable but water insoluble organic polymeric hydrocolloid for improved absorbency in cat litter applications. U.S. Pat. No. 4,615,923 to Marx discloses a dry blend of kieselguhr (diatomaceous earth) with organic gel formers (CMC, starch, dextrose, gelatin, etc.) for use in absorbent pads for food packaging.

Another absorbent composition is taught in U.S. Pat. No. 4,454,055 to Richman et al. Which discloses a dry, water swellable absorbent composition comprising a blend of a water insoluble absorbent polymer such as an ionically complexed anionic polyelectrolyte, a polysaccharide graft polymer, or a covalently linked anionic polyelectrolyte with an extender material selected from non-crosslinked cellulose derivatives, starch, certain clays and materials, and mixtures thereof The extender material(s) comprise from 1 to 75% by weight of the blend. It is stated that these blends provide significantly greater absorbency than would be expected from is the sum of the individual absorbencies of the ingredients.

Meat and poultry food products are typically sold in a supporting tray that is overwrapped by a transparent plastic film, enabling visual inspection of the food products. To avoid the uncontrolled accumulation of exuded fluids from the food products, an absorbent pad is often placed in the supporting tray. The simplest types of absorbent pads for absorbing food product fluids consist essentially of a bundle of sheets of absorbent paper with or without a sheet of plastic film below the bundle. Another sheet of plastic film may also be placed over the bundle of paper sheets. One or both of the sheets of plastic film typically are perforated or are otherwise fluid pervious.

In some configurations, the paper sheets have been replaced with a more absorbent material. For example, U.S. Pat. Nos. 4,940,621, 5,022,945, and 5,055,332 to Rhodes disclose a structure incorporating cellulose pulp fibers alone or mixed with polyolefin fibers and possibly including superabsorbent granules dispersed and held within the fiber structure. U.S. Pat. No. 5,176,930 to Kannankeril describes an absorbent pad comprising a mat of liquid absorbent material (cellulose fluff) enclosed between upper and lower sheets of plastic film with the lower sheet perforated to allow fluid to flow into the pad from the under side by capillary action. Another change to increase the absorbency of a pad taught in U.S. Pat. No. 5,176,930 involves a structural change in which a portion of the intermediate layer is allowed to extend to the periphery of the pad so as to contact fluid and wick it into the absorbent layers of the pad.

A disadvantage of the above discussed types of absorbent pads is that cellulose fluff has a low absorbency (up to about 3.5 grams per gram) and does not retain moisture under pressure. In addition these types of pads tend to break up in use so that paper, fluff, and film may adhere to the food and leakage may occur from the packages.

One way to solve the problem of leakage has been the incorporation of absorbent pads into plastic bags as described in U.S. Pat. No. 4,742,908 to Thomas, Jr. et al. and U.S. Pat. No. 4,815,590 to Pepplatt et al., both of which teach bags having an absorbent pad inserted mechanically into the bag and attached to one panel of the bag by thermal welding or glue or other adhesive means. However, attaching the pads to the bag increases the cost of production.

It is an object of the present invention to provide new dry, solid, fluid swellable, fluid absorbing compositions of matter that have improved absorbency and gel strength properties, and present minimum gel block effect.

It is another object of the present invention to provide new fluid absorbing compositions of matter that exhibit a minimum of syneresis.

It is a further object of the present invention to provide structures for absorbent articles prepared from the materials of the invention.

Yet another object of the present invention is to provide a new type of package incorporating food safety approved absorbents which incorporates an absorbent panel as part of the package. Such a package could be used for packaging of fresh poultry, meats, seafood, fresh cut fruits, vegetables, and other products, and will allow extended shelf life of the foods packaged therein under conditions appropriate for the particular food stuff.

SUMMARY OF THE INVENTION

In order to achieve the above and other objects, an absorbent material is provided which is a blend of at least one non-crosslinked gel forming polymer, at least one clay, and at least one trivalent cation. In addition, the composition can include diatomaceous earth in place of some of the clay. Further, natural gums such as xanthan, guars, and alginates can be added as can inorganic buffers. The absorbency of the blend exceeds the sum of the absorbencies of the individual components of the blend.

The gel formed as a result of absorption of fluid has high gel strength and exhibits a low level of gel block effect. In the case of food packaging applications, all components of the blend can be selected from materials known to be regulated by FDA as GRAS (generally regarded as safe) for incorporation in foods. The absorbent material of this invention is believed to be the only food safe absorbent that also provides the necessary gel strength and absorbency criteria for food packaging applications.

The non-crosslinked gel forming polymer can include cellulose derivatives, such as CMC and salts thereof, hydroxyethylcellulose, methylcellulose, hydroxypropylmethylcellulose, and also gelatinized starches, gelatin, dextrose, and the like, and mixtures thereof. The clay component can include attapulgite, montmorillonite (including bentonite clays), hectorite, sericite, kaolin, and mixtures thereof. A portion of the clay can be replaced with diatomaceous earth. The trivalent cation can be derived from aluminum sulfate, potassium aluminum sulfate, and other soluble salts of trivalent metal ions such as aluminum, chromium, and the like. The inorganic buffer can be one such as sodium carbonate (soda ash), sodium hexametaphosphate, sodium tripolyphosphate, and the like.

A method of agglomeration of the blend is described which enhances the rate of absorbency as well as increases the maximum total absorbency of the material and improves the strength of the gel formed on hydration of the material.

Structures for absorbent articles prepared from the absorbent material are described.

A new type of package for fresh foods is described which incorporates an absorbent panel that contains an absorbent material such as the absorbent material of the present invention. The package comprises a two walled bag or pouch wherein one wall is a moisture impervious thermoplastic such as polyethylene, having a desired oxygen transmission rate (OTR). The second, absorbent, wall has two plies with the outer ply being moisture impervious and made out of polyester, for example, and the inner ply being permeable to fluids and wherein an absorbent material, such as that disclosed herein, is trapped between the two plies. The two plies of the second wall are heat sealed together in a pattern so that pockets or cells are created containing the absorbent material. The bag is heat sealed around three sides and the fourth side or end can be folded over and heat sealed to the bag to seal the package.

DETAILED DESCRIPTION

The Absorbent Material

Figure 1:
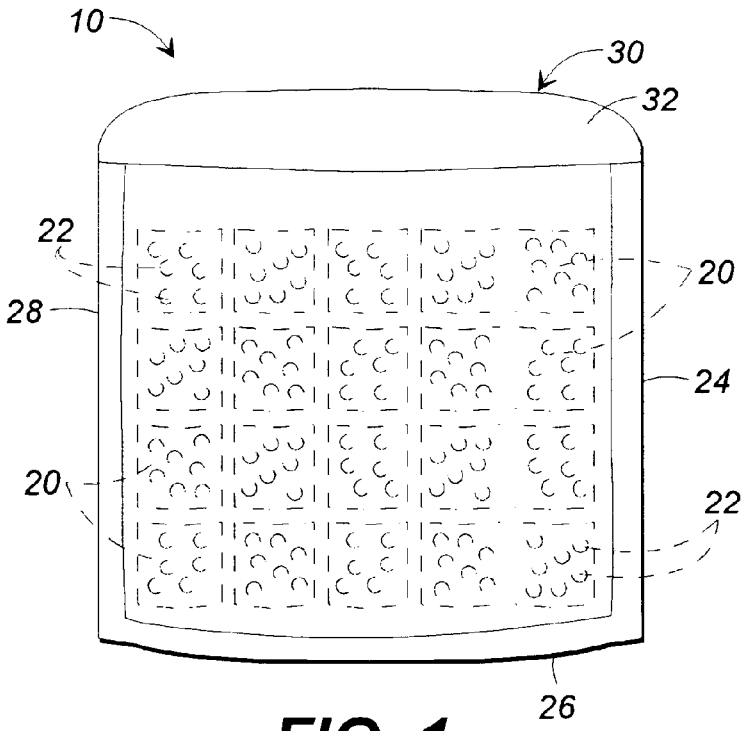
FIG. 1 is a top plan view of an absorbent article made according to the present invention.

The absorbent material contains from about 10 to 90% by weight, preferably from about 50 to about 80% by weight, and most preferably from about 70 to 75% by weight polymer. The non-crosslinked gel forming polymer can be a cellulose derivative such as carboxymethylcellulose (CMC) and salts thereof, hydroxyethylcellulose, methylcellulose, hydroxypropylmethylcellulose, gelatinized starches, gelatin, dextrose, and other similar components, and may be a mixture of the above. Certain types and grades of CMC are approved for use with food items and are preferred when the absorbent is to be so used. The preferred polymer is a CMC, most preferably sodium salt of CMC having a degree of substitution of about 0.7 to 0.9. The degree of substitution refers to the proportion of hydroxyl groups in the cellulose molecule that have their hydrogen substituted by a carboxymethyl group. The viscosity of a 1% solution of CMC at 25° C., read on a Brookfield viscometer, should be in the range of about 2500 to 12,000 mPa. The CMC used in the Examples following was obtained from Hercules, Inc. of Wilmington, Del. (under the tradename B315) or from AKZO Nobel of Stratford, Conn. (under the tradename AF3085).

The clay ingredient can be any of a variety of materials and is preferably attapulgite, montmorillonite (including bentonite clays such as hectorite), sericite, kaolin, diatomaceous earth, silica, and other similar materials, and mixtures thereof. Preferably, bentonite is used. Bentonite is a type of montmorillonite and is principally a colloidal hydrated aluminum silicate and contains varying quantities of iron, alkali, and alkaline earths. The preferred type of bentonite is hectorite which is mined from specific areas, principally in Nevada. Bentonite used in the Examples following was obtained from American Colloid Company of Arlington Heights, Ill. under the tradename Bentonite AE-H.

Diatomaceous earth is formed from the fossilized remains of diatoms, which are structured somewhat like honeycomb or sponge. Diatomaceous earth absorbs fluids without swelling by accumulating the fluids in the interstices of the structure. Diatomaceous earth was obtained from American Colloid Company.

The clay and diatomaceous earth are present in an amount from about 10–90% by weight, preferably about 20–30% by weight, however, some applications, such as when the absorbent material is to be used to absorb solutions having a high alkalinity, i.e. marinades for poultry, can incorporate up to about 50% diatomaceous earth. The diatomaceous earth can replace nearly all of the clay, with up to about 2% by weight remaining clay.

The trivalent cation is preferably provided in a soluble salt such as derived from aluminum sulfate, potassium aluminum sulfate, and other soluble salts of metal ions such as aluminum, chromium, and the like. Preferably, the trivalent cation is present at about 1 to 20%, most preferably at about 1 to 8%.

The inorganic buffer is one such as sodium carbonate (soda ash), sodium hexametaphosphate, sodium tripolyphosphate, and other similar materials. If a buffer is used, it is present preferably at about 0.6%, however beneficial results have been achieved with amounts up to about 15% by weight.

The mixture of the non-crosslinked gel forming polymer, trivalent cation, and clay forms an absorbent material which when hydrated has an improved gel strength over the non-crosslinked gel forming polymer alone. Further, the gel exhibits minimal syneresis, which is exudation of the liquid component of a gel.

In addition, the combined ingredients form an absorbent which has an absorbent capacity which exceeds the total absorbent capacity of the ingredients individually. It appears that the trivalent cation provides a cross-linking effect on the CMC once in solution, and that the clay swells to absorb and stabilize the gels. However, the mechanism of action and the synergistic effect is not yet clear. Further, as shown by Example D following, it appears that, in some cases at least, it is not necessary to add trivalent cation. It is thought that perhaps a sufficient amount of trivalent cation is present in the bentonite and diatomaceous earth to provide the crosslinking effect.

The gels formed by the absorbent material of the invention are glass clear, firm gels which may have applications in other areas such as for cosmetic materials. Preferred embodiments of the invention are set forth in Table 1.

As used in Table 1, absorption is defined as the increased weight achieved in an absorbent pad structure of the type described herein, following placement of such pad in a tray-type container with 0.2% saline therein in such quantities as to not limit the access of fluid to the pad for up to 72–96 hours until no further increase of weight is apparent. The net absorption is the difference between the final weight of the pad and the dry starting weight, after deducting the net absorbency of the base pad material other than the absorbent blend i.e. the fabric component. This is converted to a gram/gram number by dividing the net absorption by the total weight of absorbent blend incorporated in the pad. Such a procedure is accurate for comparative purposes when the pad structure used is the same for all the tested blends, which was the case in the examples given.

The solvent used may be water, saline of various salt concentrations up to 4%, or fluids from meats, poultry, fruits, or other produce. 0.2% saline simulates fluids from poultry parts.

TABLE 1

EXAMPLES OF PREFERRED EMBODIMENTS

| | | | Absorbency-gm/gm | | | |
|---|---|---|---|---|---|---|
| | Ingredient | weight % | Individual Ingredient | Expected from Summation | Actual | Actual/ Expected |
| A | CMC-B315 | 71.3 | 35 | 26.59 | 43.12 | 162.17% |
| | Potassium Aluminum Sulfate | 6.19 | 0 | | | |
| | Bentonite (i.e., Hectorite) | 22.5 | 7 | | | |
| B | CMC-AF3085 | 71.2 | 35 | 27.5 | 53.94 | 196.15% |
| | Potassium Aluminum Sulfate | 6.32 | 0 | | | |
| | Diatomaceous Earth | 20.2 | 12 | | | |
| | Bentonite | 2.25 | 7 | | | |
| C | CMC-AF3085 | 74.4 | 35 | 28.75 | 65.37 | 227.37% |
| | Potassium Aluminum Sulfate | 1.47 | 0 | | | |
| | Diatomaceous Earth | 21.2 | 12 | | | |
| | Bentonite | 2.35 | 7 | | | |
| | Soda Ash (sodium carbonate) | 0.58 | 0 | | | |
| D | CMC-AF3085 | 70 | 35 | 26.12 | 56.74 | 217.23% |
| | Diatomaceous Earth | 27 | 12 | | | |
| | Bentonite | 3 | 7 | | | |
| E | granulated CMC-AF3085 | 70.7 | 35 | 26.37 | 49.17 | 186.46% |
| | Potassium Aluminum Sulfate | 6.14 | 0 | | | |
| | Bentonite | 23.2 | 7 | | | |
| F | CMC-AF3085 | 70.8 | 35 | | | |
| | Potassium Aluminum Sulfate | 6.89 | 0 | 27.35 | 51.79 | 189.36% |
| | Bentonite | 2.23 | 7 | | | |
| | Diatomaceous Earth | 20.1 | 12 | | | |
| G | CMC-AF3085 | 54.0 | 35 | 24.67 | 48.97 | 198.5% |
| | Bentonite | 40.0 | 7 | | | |
| | Alginate | 5.94 | 50 | | | |
| | Calcium Chloride | 0.06 | 0 | | | |
| H | CMC-AF3085 | 75.3 | 35 | 27.98 | 62.51 | 223.4% |
| | Bentonite | 23.2 | 7 | | | |
| | Potassium Aluminum Sulfate | 1.5 | 0 | | | |
| I | CMC-AF3085 | 73.5 | 35 | 27.35 | 64.42 | 235.5% |
| | Bentonite | 23.2 | 7 | | | |
| | Potassium Aluminum Sulfate | 3.3 | 0 | | | |
| J | CMC-B315 | 31.82 | 35 | 18.46 | 32.85 | 177.9% |
| | Diatomaceous Earth | 54.96 | 12 | | | |
| | Bentonite | 10.44 | 7 | | | |
| | Potassium Aluminum Sulfate | 2.78 | 0 | | | |

It is apparent from the Table that a significant synergistic effect has been achieved in the absorption behavior of these blends, resulting in dramatic improvement in absorption capacity of the blends compared to the individual components. As the non-CMC ingredients are of much lower cost than CMC itself, the blends achieve major reductions in cost per unit weight of absorption.

Significant increases in absorption are realized over a wide range of CMC concentrations. However, lower concentrations of CMC tend to produce a more slimy feeling gel that is offensive to consumers. The lower concentrations of CMC may be adequate for some applications such as packaging of large bulk amounts of food products for mass producers, where the end consumer does not see or feel the gel.

Method Of Manufacture

The ingredients for the composition are mixed together and then formed into granules. It has been found that preferred embodiments of the invention may be agglomerated by processing without addition of chemicals in a compactor or disk type grariulator or similar device to produce granules of uniform and controllable particle size. Granules so formed act as an absorbent with increased rate and capacity of absorption due to the increased surface area of the absorbent. The preferred granule size is from about 75 to 1,000 microns, more preferably from about 150 to 800 microns, and most preferably from about 250 to 600 microns, with the optimum size depending upon the application. Water or another binding agent may be applied to the blend while it is being agitated in the compactor or disk type granulator which may improve the uniformity of particle size. Further, this method is a way in which other ingredients can be included in the composition, such as surfactants, deodorants and anti-microbial agents.

Articles Incorporating The Absorbent Materials

The absorbent materials described herein can be used in disposable absorbent articles where the absorbent material is used directly in absorbent articles and in absorbent "core" structures where the absorbent material is blended with non-woven fibers or other media such that particles of the absorbent material are suspended within a web or core. Such structures are disclosed in U.S. Pat. Nos. 4,410,578 to Miller, U.S. Pat. No. 4,929,480 to Midkiff et al., U.S. Pat. No. 5,176,930 to Kannankeril et al., and U.S. Pat. No. 5,055,332 to Rhodes et al., the disclosures of which are incorporated herein, in their entireties, by reference.

The absorbent material can be placed between laminations or layers of liquid permeable materials such as non-woven fabric, cellulose fiber webs, etc. or between liquid impermeable fibers of melt-blown sheeting, etc. Liquid permeable layers can also be laminated to a layer of impermeable material such as a polymeric film. The absorbent held between the layers, laminates or fibers will swell on contact with fluids permeating through to the absorbent material. The gel it which forms retains the moisture within the structure of the absorbent article and is not released.

When providing a laminate, it is necessary to select the materials of the laminate such that the absorbent material is effectively retained within the laminated article while in the dry state with adequate permeation of fluid being possible through the permeable layer(s) so that the gel is retained within the laminated layers and not released through the pores of the fabric layers. The lamination may be constructed in such a way that the components of the lamination are sealed to each other in continuous fashion around the periphery of the absorbent article, or in cross hatch or quilted pattern to allow small amounts of the absorbent to be held in ipockets within the absorbent structure. The cross hatch seals can be designed to create a cellular pattern of varying sizes and shapes dependent upon the level and uniformity of absorption needed for the particular application.

The distribution of particles of the absorbent material throughout the web makes a larger surface area of the absorbent accessible to the fluids being absorbed. The amount of absorbent to be used in the absorbent core or article will vary according to the intended use and those of skill in the art can determine by experiment what are the best combinations of absorbent and core materials to be used for a particular application.

Absorbent Package For Fresh Food Products

Figure 2:
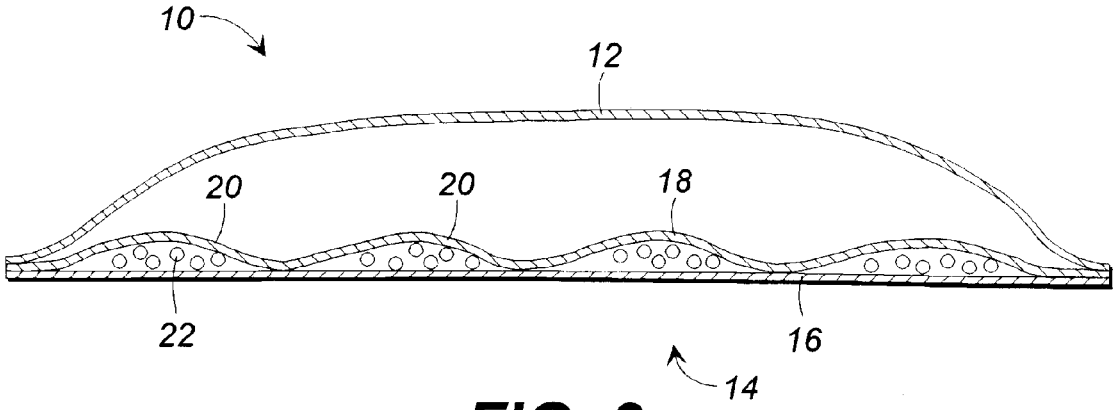
FIG. 2 is a side elevational view of the article of FIG. 1.

A specific embodiment of a laminated structure is illustrated in FIGS. 1 and 2. The structure is especially useful for storage of food products which exude liquids but may have other applications. In particular, it has been discovered that the structure described hereinbelow provides the advantage of prolonging the preservation or shelf life of food products, such as vegetables, etc., stored therein, even though no visible moisture to be absorbed is present in the structure. The structure may be manufactured with the absorbent material of the present invention or the structure can employ absorbent materials currently known.

The absorbent package 10 comprises a two walled bag having a first wall 12 of a liquid impervious and preferably transparent thermoplastic such as polyethylene. This layer preferably has a low gas permeability for meat and poultry products but a higher gas permeability for fruit and vegetable products so as to allow ethylene to escape from inside the package and oxygen to move inside the package. The desired specific OTR (oxygen transport rate) of the layer will depend upon the foods to be packaged.

The second wall 14 of the bag is a laminated structure having at least two plies, a first ply 16 which is on the outside of the bag and comprises a liquid impervious thermoplastic such as polyester/polyethylene laminate and a second ply 18, which faces the food product, and comprises a liquid and gas permeable material. This material should be compatible with food items and can be a bi-component non-woven fabric comprised of fibers having a polyester core with a polyethylene sheath. The fabric is made through standard techniques such as by carding the fibers, passing the carded fibers through an oven, and then through nip rolls to "iron" the fabric into a more compact non-woven fabric. In addition, the heat and ironing cause fusion between the fibers. An open mesh fabric is created that is permeable to liquids and gases.

The non-woven permeable inner ply 18 is heat sealed to the polyester/polyethylene outer ply 16 in a pattern so as to form an array of cells 20. Prior to sealing of the plies in a pattern so as to form cells, an absorbent such as the one disclosed herein is placed between the two plies, so that a certain amount of absorbent 22 is trapped within each cell.

The resulting absorbent material can be fashioned into a number of different structure or flexible packages, such as pouches, thermoformed packs, lidding materials, or other packages. To form a pouch or bag as shown in FIG. 1, a large double walled sheath of material can be prepared and then cut to the desired size and heat sealed around three sides 24, 26, 28 to form a bag having an open side 30 with flap 32. The flap 32 can be an overlapping piece of either the polyethylene first wall or the polyester/ polyethylene ply. After fillage with the product (such as diced fruit or tomatoes, poultry parts or meats) the flap 32 can be folded over and,heat sealed to the bag. The presence of the array of cells makes possible the formation of various size bags from the double walled sheet having discrete absorbent areas and prevents spillage of absorbent from between the two plies. The two ply second wall can be made by standard techniques as can the two wall sheath of material and the two wall bags.

The permeable or inner ply of the absorbent wall can have a dual layer structure with two layers of the same fibers. The fibers are packed more closely together on the side which is closer to the absorbent and are packed into a more open network on the side closer to the packaged products. In this way the absorbent ply has smaller pores on the side closer to the absorbent and the absorbent is thus unlikely to migrate through the fabric. On the other hand, the ply next to the liquid has larger pores to encourage migration of the liquid therethrough.

Figure 3:
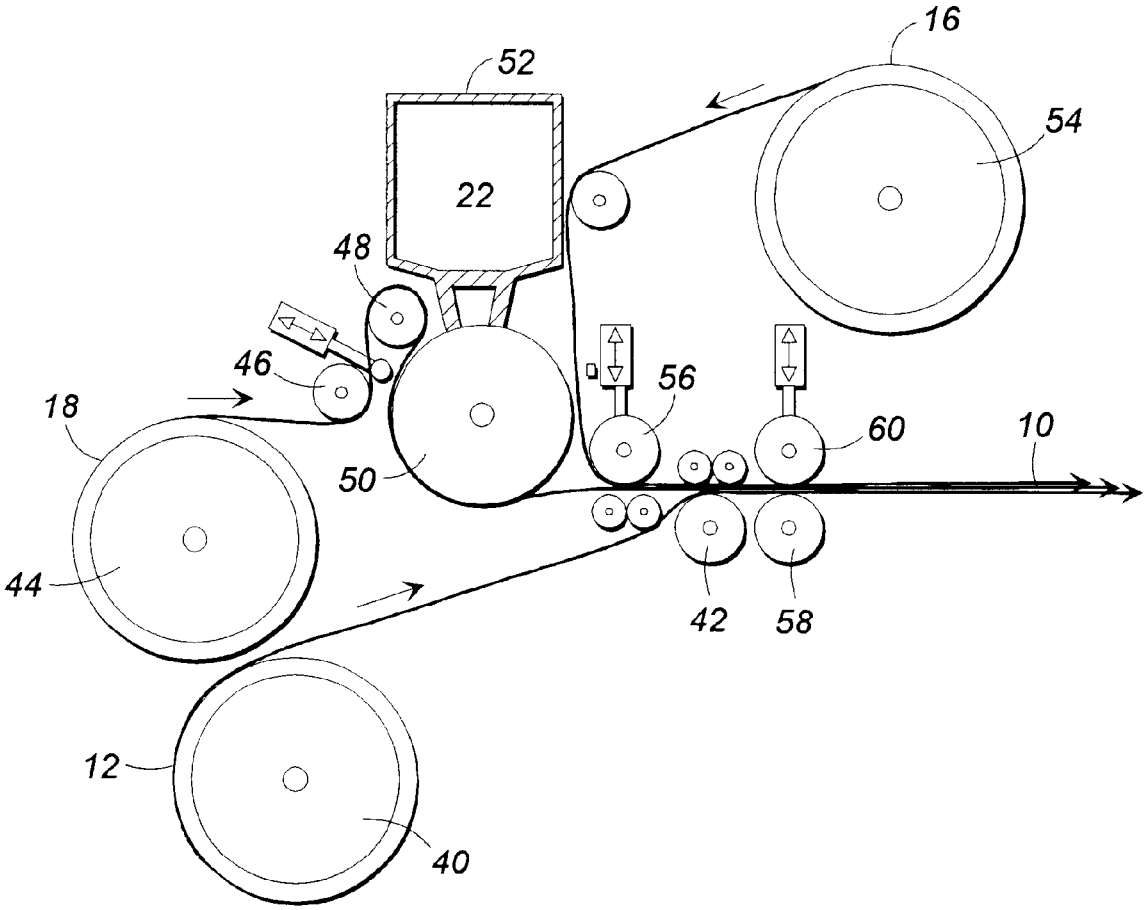
FIG. 3 is a schematic illustration of the apparatus used in a method of making an article of the present invention.

A method of making a sheet of absorbent material as described above is shown in FIG. 3. The thermoplastic film for first wall 12 is supplied from first supply roll 40 to second heated roll 42. The non-woven fabric 18 is supplied from second supply roll 44 to powder dispensing roller 50 via rollers 46 and 48. Absorbent powder 22 from dispensing hopper 52 is deposited onto fabric 18 as fabric 18 passes by roller 50. The thermoplastic film to form outer ply 16 of second wall 14 is delivered from supply roll 54 to first heated roller 56 that also receives fabric 18. Film 16 and fabric 18 are heat sealed together in the desired pattern by heated roller 56. The film to form first wall 12 is heat sealed to the combined film/ fabric by second heated roll 42, third heated roll 58, and fourth heated roll 60 into bags 10 or other flexible packages of the desired shape and size.

While a specific embodiment of a flexible package is described above, the invention is not intended to be limited to the embodiment described. Other embodiments of flexible packages are envisioned utilizing the two ply absorbent fabric described above.

Additionally, sealable food storage containers of various sizes, and shapes can be provided with an absorbent article which contains an amount of absorbent material of known composition or of the composition of the present invention. In a preferred embodiment, the absorbent article is formed as a pad or other suitable structure containing the absorbent material, with at least a portion of the pad being constructed of fluid permeable material. The pad is placed within a container having food products stored therein when little or no visible moisture is present within the container and the container is then sealed for storage. In a novel aspect of the present invention, it has been discovered that the addition of the absorbent article to the sealed container significantly increases the preservation or shelf life of the food products, such as vegetables, fruits, etc. which have been prepared by cutting, slicing, chopping, etc., sealed within the container even though the absorbent material of the pad absorbs little to no visible moisture from within the container.

Although the precise mechanism for prolonging the preservation of food products by the method set out above is not heretofore known, it is speculated that the absorbent material inhibits the reproduction and growth of microorganisms, such as by trapping the microorganisms within the structure of the material, etc. Additionally, the absorbent material may adsorb gaseous products from the interior of the storage container, such as ethylene which is release by the food products during ripening and/or degradation. However, while the precise mechanism may be unknown, the advantages offered by the method of the present invention may conveniently be practiced by one of ordinary skill in the art with reference to the disclosure above.

The foregoing description has been presented for purposes of illustration and description. It is not intended to be exhaustive or to limit the invention to the precise forms disclosed. Obvious modifications or variations are possible in light of the above teachings. The embodiment or embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly and legally entitled.

What is claimed is:

1. A food safe absorbent composition of matter suitable for use with food products, said absorbent composition of matter having an absorbency, the absorbency being defined by weight of liquid absorbed/weight of said absorbent composition of matter, said absorbent composition of matter consisting essentially of:

a) at least one non-crosslinked gel-forming water soluble polymer having a first absorbency, said first absorbency being defined by weight of liquid absorbed/weight of said at least one non-crosslinked gel forming polymer, said at least one non-crosslinked gel forming polymer being food safe;

b) at least one mineral composition having a second absorbency, said second absorbency being defined by weight of liquid absorbed/weight of said at least one mineral composition, said at least one mineral composition being food safe; and c) at least one soluble salt having at least one trivalent cation, said at least one soluble salt having at least one trivalent cation being food safe, the absorbency of said absorbent composition of matter exceeding a sum of said first absorbency and said second absorbency said absorbent composition of matter being compatible with food products such that said absorbent composition of matter is food safe when in direct contact with the food products.

2. The composition of claim 1, wherein said non-crosslinked gel-forming polymer is selected from the group consisting of carboxymethylcellulose and salts thereof, hydroxyethylcellulose, methylcellulose, hydroxypropylmethylcellulose, gelatinized starches, gelatin, and dextrose.

3. The composition of claim 1, wherein said non-crosslinked gel-forming polymer is the sodium salt of carboxymethylcellulose and is present at an amount of about 50 to 80% by weight.

4. The composition of claim 1, wherein said non-crosslinked gel-forming polymer is the sodium salt of carboxymethylcellulose and is present at an amount of about 70 to 75% by weight.

5. The composition of claim 1, wherein said at least one mineral composition is a clay selected from the group consisting of attapulgite, montmorillonite, bentonite, hectorite, sericite, and kaolin.

6. The composition of claim 1, wherein said at least one mineral composition is bentonite and is present at an amount of about 20 to 30% by weight.

7. The composition of claim 1, wherein said at least one soluble salt having at least one trivalent cation is potassium aluminum sulfate present at an amount of about 1 to 8% by weight.

8. The composition of claim 1, wherein said composition is formed into granules.

9. The composition of claim 8, wherein said granules have a size of about 250 to 600 $\mu$m.

10. An absorbent article comprising said absorbent composition of matter of claim 1.

11. A food safe absorbent composition of matter suitable for use with food products, said absorbent composition of matter having an absorbency, the absorbency being defined by weight of liquid absorbed/weight of said absorbent composition of matter, said absorbent composition of matter consisting essentially of:

a) at least one non-crosslinked gel-forming polymer having a first absorbency, said first absorbency being defined by weight of liquid absorbed/weight of said at least one non-crosslinked gel forming polymer, said at least one non-crosslinked gel forming polymer being food safe;

b) at least one mineral and diatomaceous earth composition having a second absorbency, said second absorbency being defined by weight of liquid absorbed/weight of said at least one mineral and diatomaceous earth composition, said at least one mineral and diatomaceous earth composition being food safe; and c) at least one soluble salt having at least one trivalent cation, said at least one soluble salt having at least one trivalent cation being food safe, the absorbency of said absorbent composition of matter exceeding a sum of said first absorbency and said second absorbency, said absorbent composition of matter being compatible with food products such that said absorbent composition of matter is food safe when in direct contact with the food products.

12. The composition of claim 11, wherein said at least one mineral composition and said diatomaceous earth are present at an amount of about 20 to 30% by weight.

13. A food safe absorbent composition of matter suitable for use with food products, said absorbent composition of matter having an absorbency, the absorbency being defined by weight of liquid absorbed/weight of said absorbent composition of matter, said absorbent composition of matter consisting essentially of:

a) at least one non-crosslinked gel-forming polymer having a first absorbency, said first absorbency being defined by weight of liquid absorbed/weight of said at least one non-crosslinked gel forming polymer, said at least one non-crosslinked gel forming polymer being food safe;

b) at least one mineral composition having a second absorbency, said second absorbency being defined by weight of liquid absorbed/weight of said at least one mineral composition, said at least one mineral composition being food safe; and c) at least one soluble salt having at least one trivalent cation, said at least one soluble salt having at least one trivalent cation being food safe;

d) at least one inorganic buffer, said inorganic buffer being food safe, the absorbency of said absorbent composition of matter exceeding a sum of said first absorbency and said second absorbency, said absorbent composition of matter being compatible with food products such that said absorbent composition of matter is food safe when in direct contact with the food products.

14. A food safe absorbent composition of matter suitable for use with food products, said absorbent composition of matter having an absorbency, the absorbency being defined by weight of liquid absorbed/weight of said absorbent composition of matter, said absorbent composition of matter consisting essentially of:

a) at least one non-crosslinked gel-forming polymer having a first absorbency, said first absorbency being defined by weight of liquid absorbed/weight of said at least one non-crosslinked gel forming polymer, said at least one non-crosslinked gel forming polymer being food safe;

b) at least one mineral and diatomaceous earth composition having a second absorbency, said second absorbency being defined by weight of liquid absorbed/weight of said at least one mineral and diatomaceous earth composition, said at least one mineral and diatomaceous earth composition being food safe;

c) at least one soluble salt having at least one trivalent cation, said at least one soluble salt having at least one trivalent cation being food safe; and d) at least one inorganic buffer, said inorganic buffer being food safe, the absorbency of said absorbent composition of matter exceeding a sum of said first absorbency and said second absorbency, said absorbent composition of matter being compatible with food products such that said absorbent composition of matter is food safe when in direct contact with the food products.

* * * * *